US010674805B2

(12) United States Patent
Zhou

(10) Patent No.: US 10,674,805 B2
(45) Date of Patent: Jun. 9, 2020

(54) DEFORMABLE HOLDER FOR A SPRAY BOTTLE

(71) Applicant: Ningbo ZIIER Network Technology Co., Ltd., Ningbo, Zhejiang Province (CN)

(72) Inventor: Jian Zhou, Ningbo (CN)

(73) Assignee: Ningbo ZIIER Network Technology Co., Ltd., Ningbo, Zhejiang (CN)

( * ) Notice: Subject to any disclaimer, the term of this patent is extended or adjusted under 35 U.S.C. 154(b) by 0 days.

(21) Appl. No.: 16/246,480

(22) Filed: Jan. 12, 2019

(65) Prior Publication Data

US 2020/0100582 A1 Apr. 2, 2020

(51) Int. Cl.
*A45F 5/12* (2006.01)
*B05B 11/00* (2006.01)

(52) U.S. Cl.
CPC ..... *A45F 5/12* (2013.01); *A45F 2200/0566* (2013.01); *A45F 2200/0583* (2013.01); *B05B 11/0005* (2013.01)

(58) Field of Classification Search
CPC ..... A45F 2200/0583
USPC ..... 222/173, 175, 180
See application file for complete search history.

(56) References Cited

U.S. PATENT DOCUMENTS 6,131,779 A * 10/2000 Gendala ..... A45F 5/02 224/148.1
2003/0141330 A1* 7/2003 McDonald ..... A45F 5/02 224/242
2009/0114679 A1* 5/2009 Ophardt ..... B65D 1/0292 222/105
2009/0236254 A1* 9/2009 Jenkins ..... A47K 5/12 206/459.5
2011/0259920 A1* 10/2011 Rennie ..... A47K 5/1205 222/165
2012/0111890 A1* 5/2012 Herring ..... A47K 5/12 222/180

* cited by examiner

*Primary Examiner* — Donnell A Long
(74) *Attorney, Agent, or Firm* — Craft Chu PLLC; Andrew W. Chu

(57) ABSTRACT

A deformable spray bottle holder includes a first supporting seat and a second supporting seat. The upper end of the first supporting seat is provided with a connecting port for communicating with a mouth of a liquid container. The bottom end of the first supporting seat is provided with a first horizontal member. The first supporting seat and the second supporting seat are hinged together. The second supporting seat is provided with a hook member. When the second supporting seat is upturned, the hook member is used as a pothook. When the second supporting seat is turned upside down, the hook member and the first horizontal member of the first supporting seat abut.

9 Claims, 8 Drawing Sheets

DEFORMABLE HOLDER FOR A SPRAY BOTTLE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to the technical field of spray bottle, and specifically to a deformable spray bottle chassis.

2. Description of Related Art Including Information Disclosed Under 37 CFR 1.97 and 37 CFR 1.98

The existing spray bottle usually comprises a spray head and a bottle body. The bottle body can be made into many kinds of shapes with a horizontal bottom for being placed on a horizontal desk, so that it is not easy to tilt down. The bottle body is filled with all kinds of liquid such as hand sanitizer, disinfectant, or insecticide, or even just pure water.

The existing bottle body has a huge volume. When the kind of the filled liquid is about to be changed, the bottle body should be detached from the spray head, so that the remaining liquid in the bottle body can be poured out and cleaned first and then the new liquid can be fill in, thus preventing the service life of the liquid is influenced because of the mixture of liquid.

Such spray bottle is difficult to operate, and there must be some liquid residue of previous liquid. The existing pocket mouth of bottle body cannot be placed on other space other than on a desk, which brings out too many limitations.

BRIEF SUMMARY OF THE INVENTION

The Problem Sought to be Solved by the Invention

With respect to the defects of the prior art, the present invention provides a deformable spray bottle chassis for solving the problem that existing spray bottle has too many structural limitations, has only simple structures, is difficult to switch liquid, and has limited placing spaces.

The Technical Solution for Solving Such Technical Problem

A deformable spray bottle chassis, comprising: a first supporting seat and a second supporting seat; the upper end of the first supporting seat is provided with a connecting port for communicating with a pocket mouth of a liquid packing bag; the bottom end of the first supporting seat is provided with a first horizontal member; the first supporting seat and the second supporting seat are hinged together; the second supporting seat is provided with a hook member; when the second supporting seat is upturned, the hook member is used as a pothook; when the second supporting seat is turned upside down, the hook member and the first horizontal member of the first supporting seat abut. By switching the positions of the second supporting seat, the deforming function of the spray bottle chassis is realized.

Preferably, an internal thread is provided inside the connecting port, for engaging the screw thread of the pocket mouth of the liquid packing bag. Simple engagement with the liquid packing bag is realized.

Preferably, the connecting port is connected with a spray head. The connecting port can not only be connected with the spray head, but also can be connected with other nozzles.

Preferably, the hook member comprises a second horizontal member and a vertical member; when the second supporting seat is turned upside down, the second horizontal member and the first horizontal member of the first supporting seat abut. The supporting force of the first horizontal member is enhanced.

Preferably, the first supporting seat is provided with a first edgefold, the second supporting seat is provided with a second edgefold. The design of the edgefold dramatically increases the structural strength of the product whiling keeping the same wall thickness; the first edgefold can not only increase the structural strength, but also can fix the second supporting seat for prevent it from moving from side to side.

Preferably, a calabash-shaped hole is provided at the inner side of the second supporting seat; the calabash-shaped hole consists of two openings with different sizes; the first supporting seat is provided with a cylindrical protrusion; the cylindrical protrusion is inserted into the calabash-shaped hole; the cylindrical protrusion is provided with two tangent planes that are respectively a top and a bottom plane. Openings with different sizes are in favor of two assemblies; the cylindrical protrusion is the revolving shaft of the second supporting seat; tangent planes facilitate the mold stripping, while damping effect exists during the rotation.

Preferably, a first location hole is provided at the inner side of the second supporting seat; the first supporting seat is provided with a second location hole; the first location hole is used for aligning with the second location hole. Such small circle point has an orientating function.

Preferably, a hanging nose is provided at the outer side of the second supporting seat; the hanging nose is provided with a suspension loop; the hanging nose also comprises a first pothook member and a second pothook member. Small objects such as bath sponge can be hung on the first pothook member; the suspension loop can have its circular hole be hung on hooks; the second pothook member can be hung on some tubular poles.

Preferably, a circular-arc shaped locating notch is arranged at the bottom of the second supporting seat; a lateral plastic reinforcement member is arranged at the upper portion of the second supporting seat; a projecting reinforcement member is arranged at the outer side of the second supporting seat. Three circular-arc shaped locating notches will help the spray bottle be easily fixed on the tubular pole; a lateral plastic reinforcement member and the projecting reinforcement member are both for enhancing the structural strength.

Preferably, the first horizontal member of the first supporting seat is 5 provided with an elongated location hole for aligning with the second supporting seat.

Advantageous Effects

Compared with the prior art, the present invention can be quickly detached with the liquid packing bag; it is not limited by the spatial position, which cannot only be place on a desk, but can also be hanged on a pothook.

DETAILED DESCRIPTION OF THE INVENTION

Figure 1:
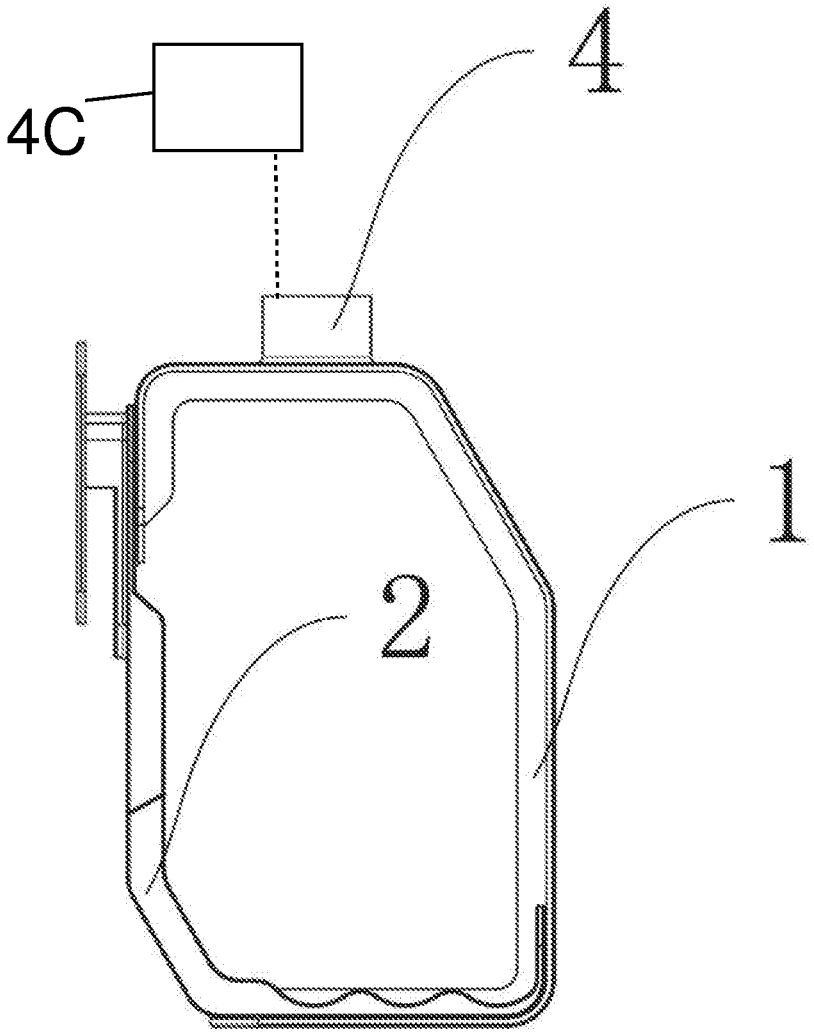
FIG. 1 is a front view of the present invention.
Figure 2:
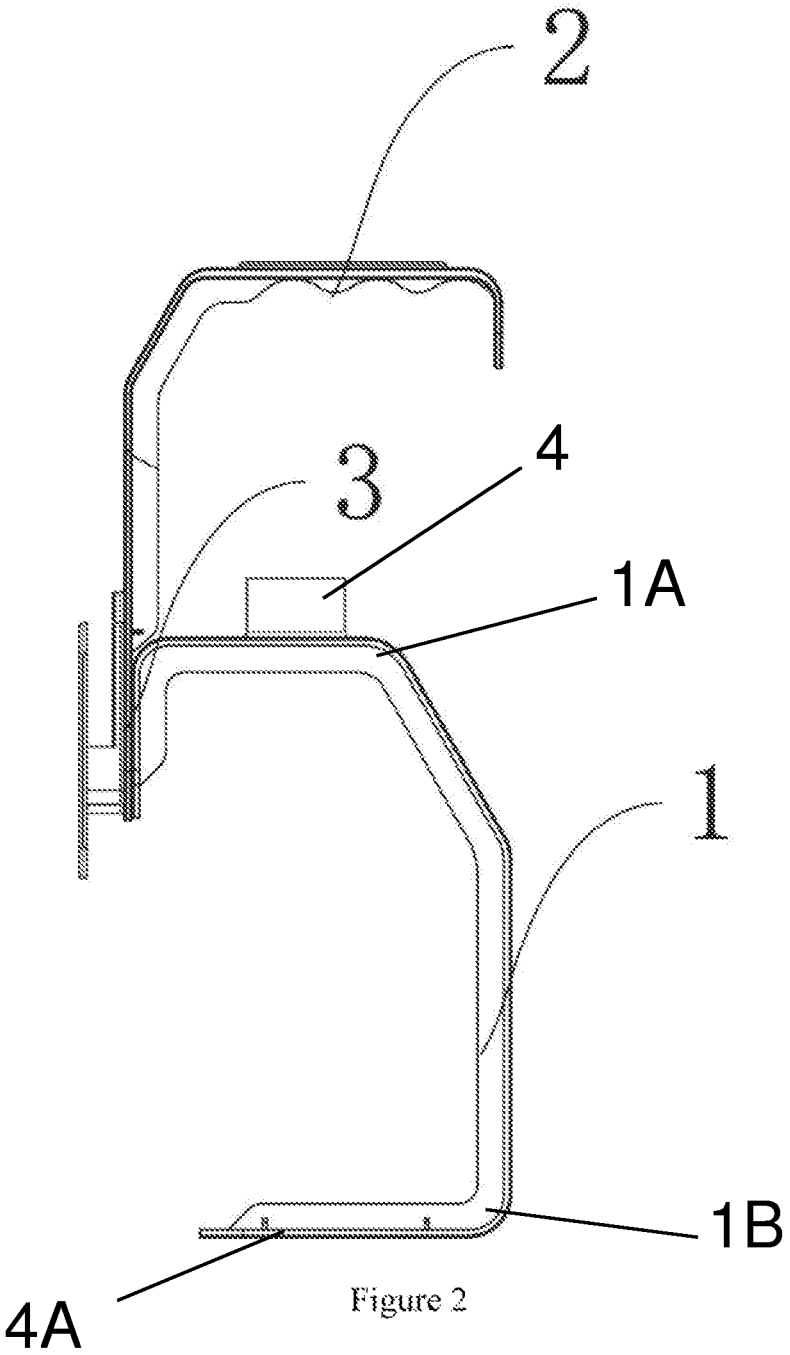
FIG. 2 is a front view of a second embodiment of the present invention.
Figure 3:
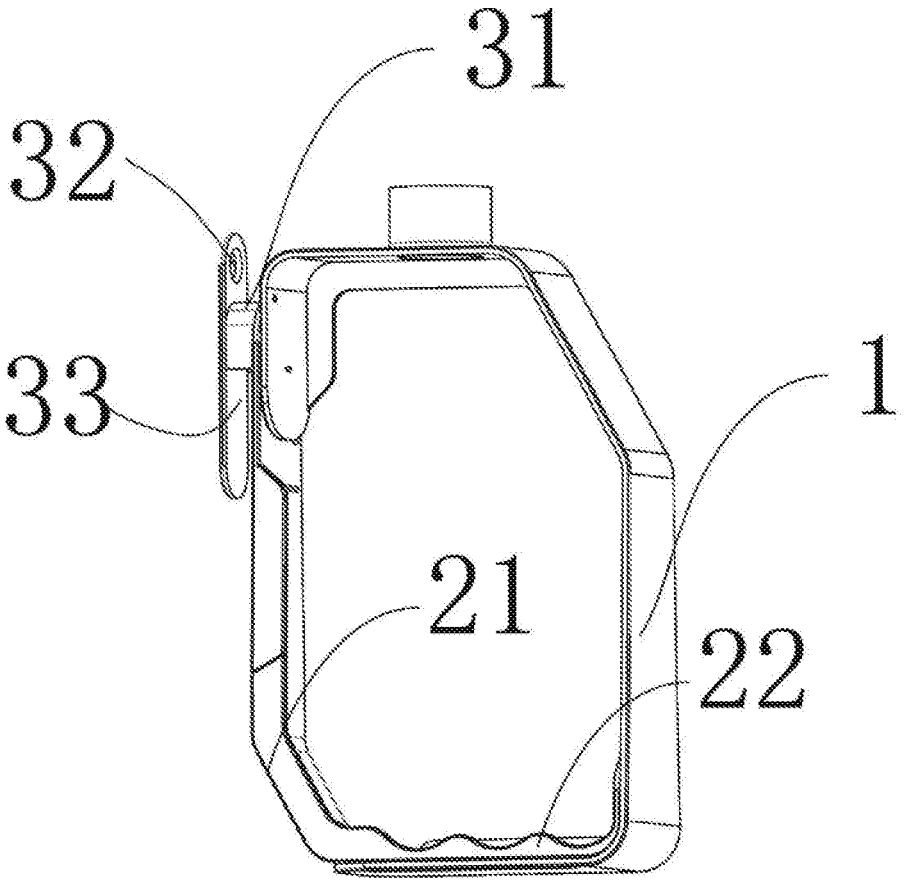
FIG. 3 is a structure diagram of a first embodiment of the present invention.
Figure 4:
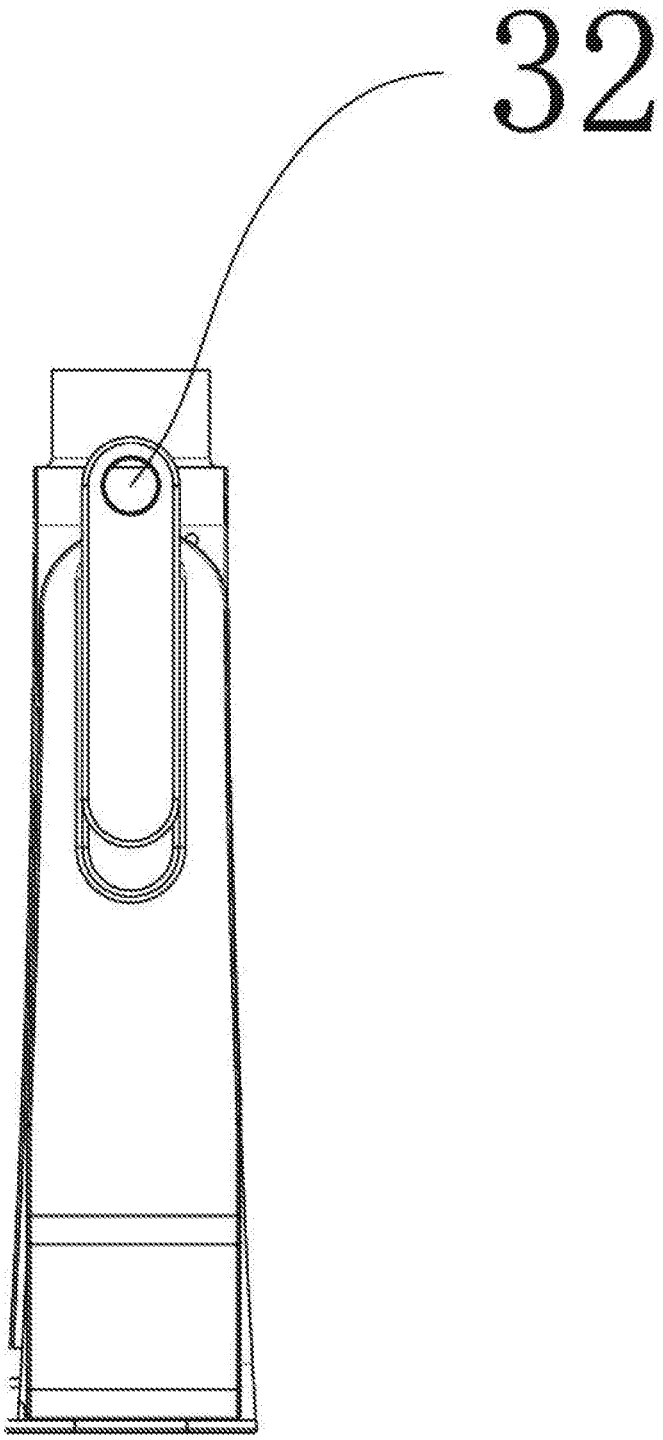
FIG. 4 is a side view of the present invention.
Figure 5:
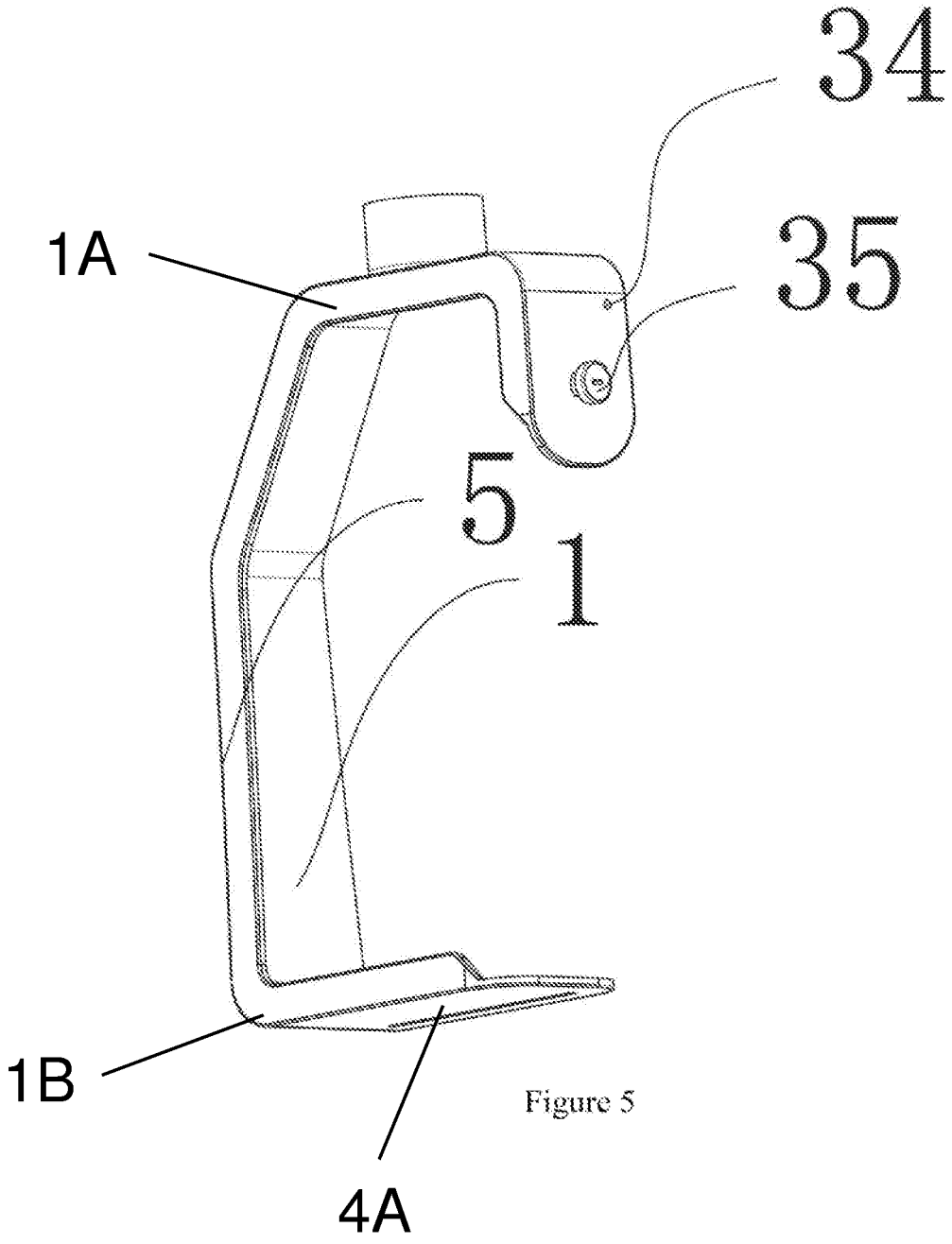
FIG. 5 is a first diagram of the first supporting seat of the present invention.
Figure 6:
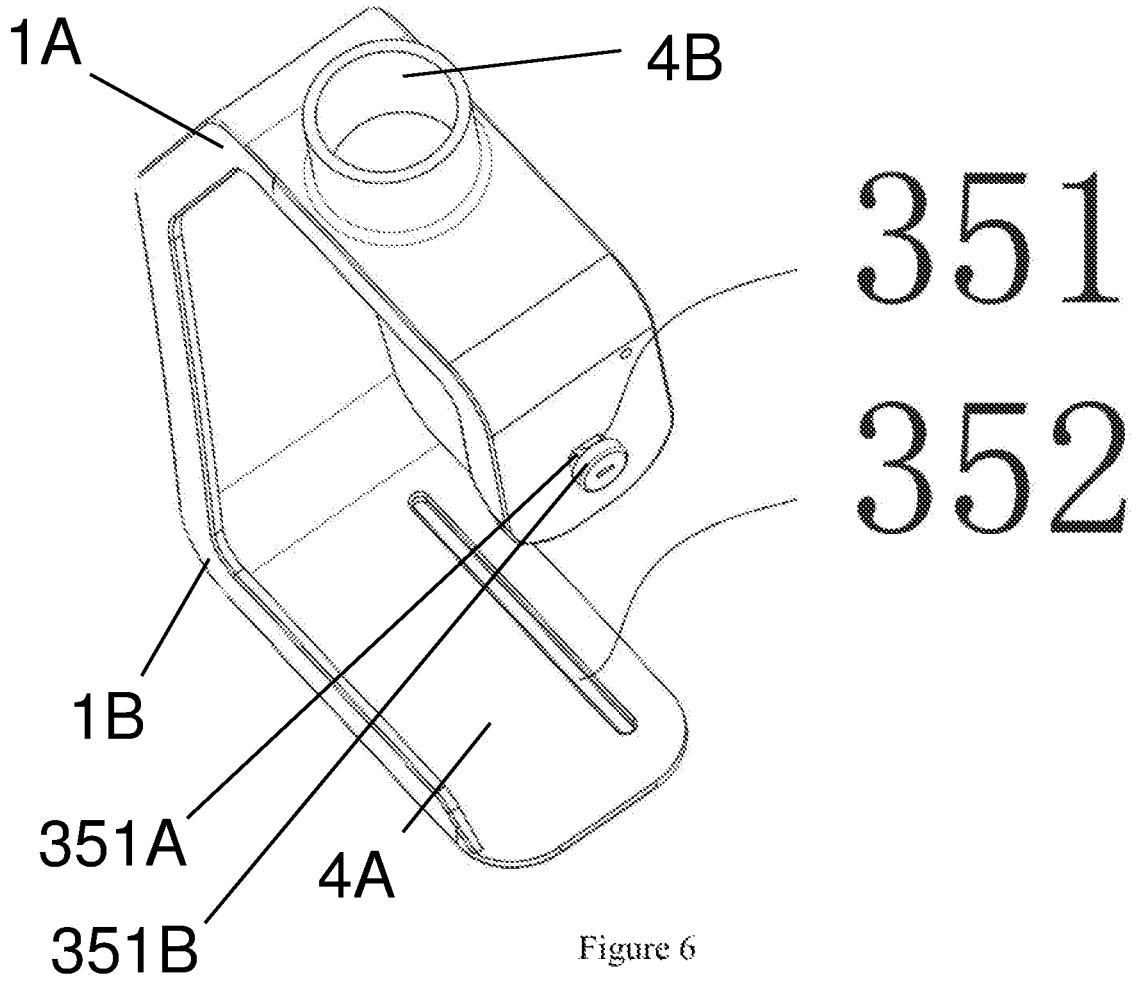
FIG. 6 is a second diagram of the first supporting seat of the present invention.
Figure 7:
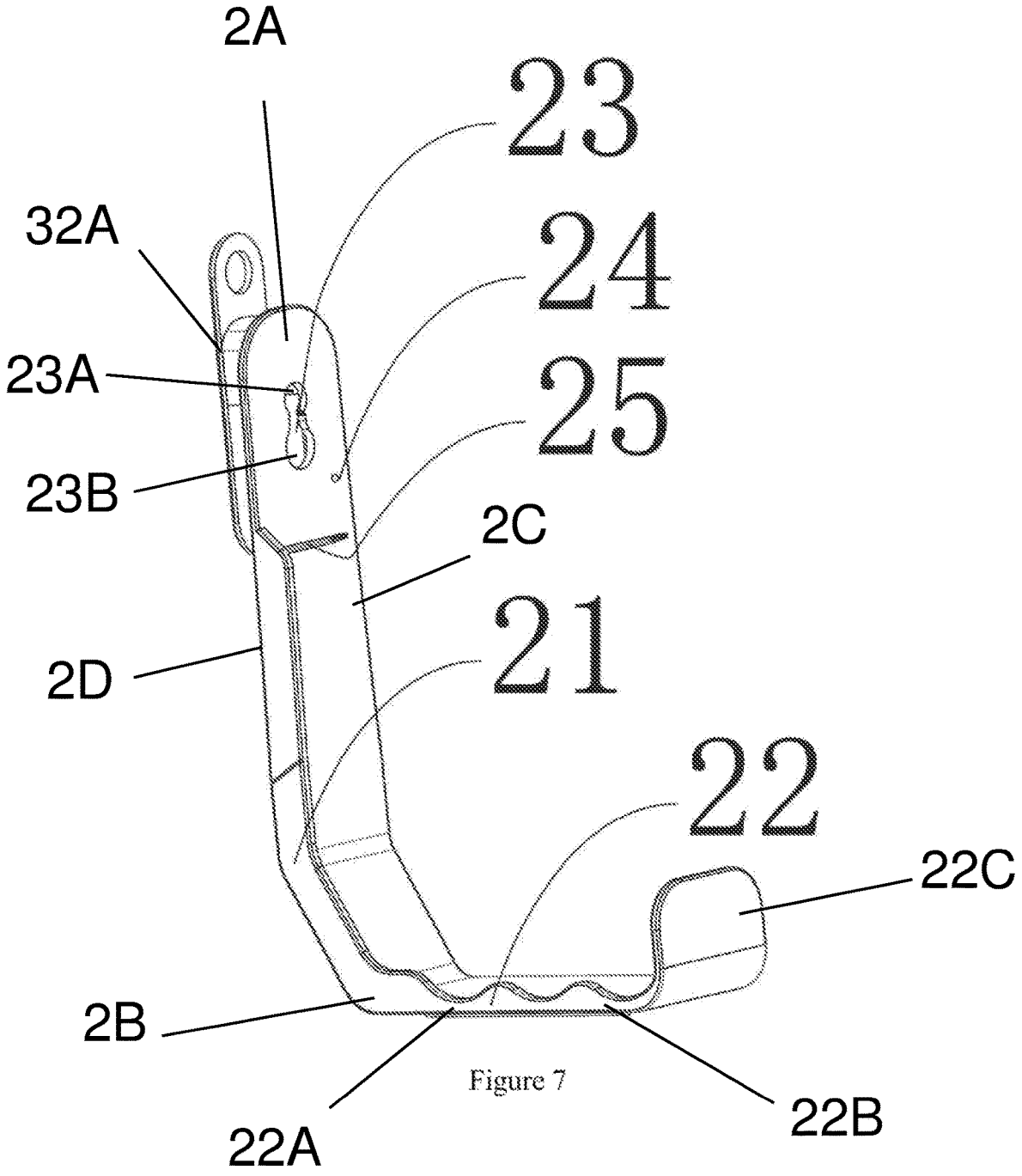
FIG. 7 is a first diagram of the second supporting seat of the present invention.
Figure 8:
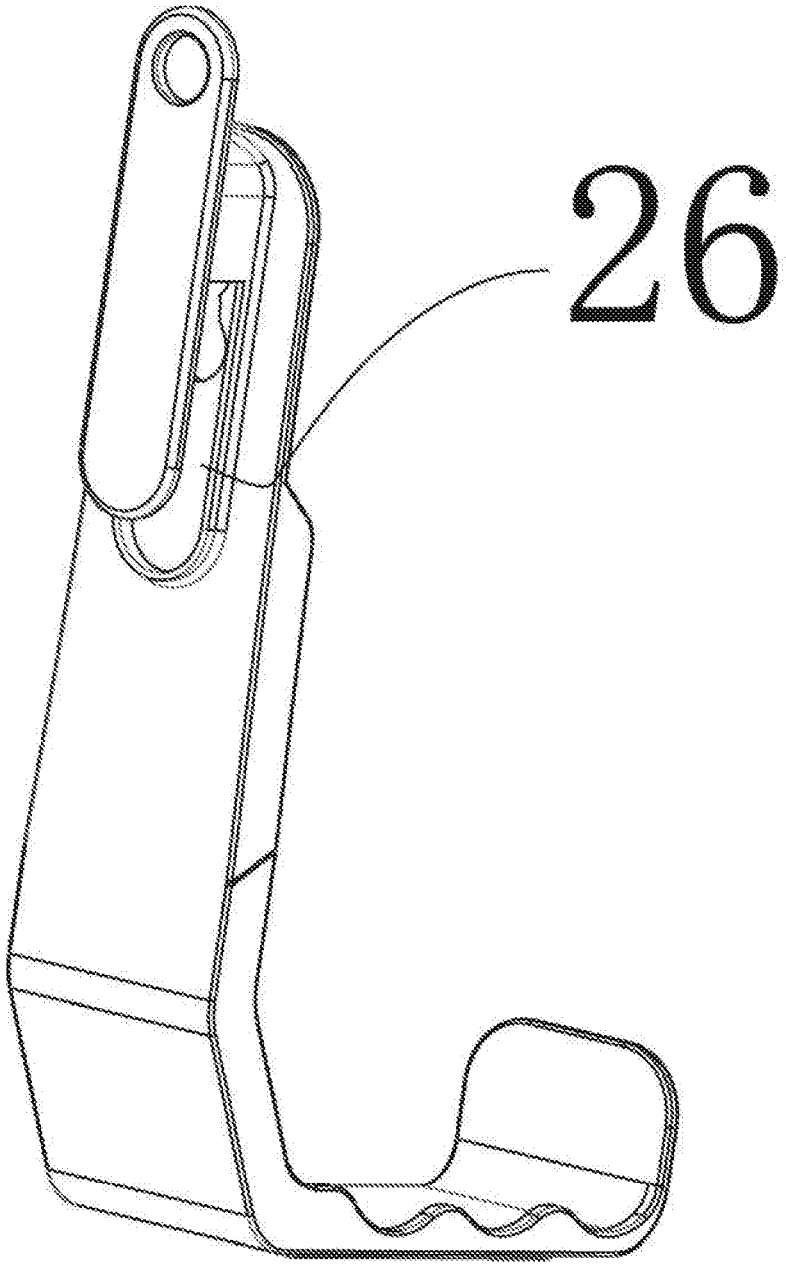
FIG. 8 is a second diagram of the second supporting seat of the present invention.

In the following, the invention will be explained in details with reference to the accompanying drawings.

A deformable spray bottle chassis comprises a first supporting seat 1 and a second supporting seat 2; the upper end or first supporting upper end 1A of the first supporting seat 1 is provided with a connecting port 4 for communicating with a pocket mouth of a liquid packing bag; the bottom end or first supporting bottom end 1B of the first supporting seat 1 is provided with a first horizontal member 4A; the first supporting seat 1 and the second supporting seat 2 are hinged at pivot point 3 together; the second supporting seat 2 is provided with a second supporting upper end 2A, a second supporting lower end 2B, a second supporting inner side 2C, and a second supporting outer side 2D, the second supporting upper end having a hook member 22A. When the second supporting seat 2 is upturned, the hook member is used as a pothook when. When the second supporting seat 2 is turned upside down, the hook member and the first horizontal member of the first supporting seat 1 abut. An internal thread 4B is provided inside the connecting port 4, for engaging the screw thread of the pocket mouth of the liquid packing bag. The connecting port 4 is connected with a spray head 4C. The hook member 22A comprises a second horizontal member 22B and a vertical member 22C. When the second supporting seat 2 is turned upside down, the second horizontal member and the first horizontal member of the first supporting seat 1 abut. The first supporting seat 1 is provided with a first edgefold 5; and the second supporting seat 2 is provided with a second edgefold 21. A calabash-shaped hole 23 is provided at the inner side 2C of the second supporting seat 2; the calabash-shaped hole 23 consists of two openings with different sizes (first opening 23A with a first size and second opening 23B with a second size, the first size being different from the second size); the first supporting seat 1 is provided with a cylindrical protrusion 35; the cylindrical protrusion 35 is inserted into the calabash-shaped hole 23; the cylindrical protrusion 35 is provided with two tangent planes 351 that are respectively a top and a bottom plane (a top plane 351A and a bottom plane 351B so as to set friction fit engagement with the calabash-shaped hole 23). A first location hole 24 is provided at the inner side 2C of the second supporting seat 2; the first supporting seat 1 is provided with a second location hole 34; the first location hole 24 is used for aligning with the second location hole 34. A hanging nose or hanging member 32A is provided at the outer side of the second supporting seat 2; the hanging nose is provided with a suspension loop 32; the hanging nose also comprises a first pothook member 31 and a second pothook member 33. A circular-arc shaped locating notch 22 is arranged at the bottom of the second supporting seat 2; a lateral plastic reinforcement member 25 is arranged at the upper portion of the second supporting seat 2; a projecting reinforcement member 26 is arranged at the outer side 2D of the second supporting seat 2. The first horizontal member of the first supporting seat 1 is provided with an elongated location hole 352.

During application, first of all, the liquid packing bag should be placed; a 10 joined column on the top of the liquid packing bag is screwed into the connecting port 4, with the screw threads of those two engaged.

First Embodiment

When it is about to be place on a plane, the second supporting seat 2 is turned upside down, the second horizontal member and the first horizontal member of the first supporting seat 1 abut, and the deformable spray bottle chassis is then placed on the plane.

Second Embodiment

When it is about to be place on a pothook, the second supporting seat 2 is upturned, the hook member is used as a pothook, and the pothook is hooked with a suspending part, thus completing the arrangement.

The above descriptions are only some preferred embodiments, and it should be pointed out that, as for a person skilled in the art, modifications and alternatives can be made without departing from the discipline of the invention, and such modifications and alternative also fall within the scope of the invention.

I claim:

1. A deformable spray bottle holder, comprising:

a first supporting seat a first supporting upper end with a connecting port and a first supporting bottom end with a first horizontal member; and a second supporting seat being hinged at pivot point to said first supporting seat, said second supporting seat having a second supporting upper end with said pivot point, a second supporting lower end with a hook member, a second supporting inner side, and a second supporting outer side, wherein said second supporting seat has an upturned position relative to said first supporting seat, and, wherein said second supporting seat has a turned upside down position relative to said first supporting seat with said hook member abutting said first horizontal member, wherein said second supporting inner side is comprised of a calabash-shaped hole at said pivot point of said second supporting upper end, wherein said calabash-shaped hole is comprised of a first opening with a first size and a second opening with a second size, said first size being different from said second size, wherein said first supporting upper end is comprised of a cylindrical protrusion removably inserted into said calabash-shaped hole, and wherein said cylindrical protrusion is comprised of a top plane and a bottom plane in friction fit engagement with said calabash-shaped hole.

2. The deformable spray bottle holder, according to claim 1, wherein said connecting port is comprised of an internal thread.

3. The deformable spray bottle holder, according to claim 1, further comprising: a spray head being removably connected to said connecting port.

4. The deformable spray bottle holder, according to claim 1, wherein said hook member comprises a second horizontal member and a vertical member, said second horizontal member abutting said first horizontal member in said turned upside down position of said second supporting seat.

5. The deformable spray bottle holder, according to claim 1, wherein said first supporting seat is comprised of a first edgefold, and wherein said the second supporting seat is comprised of a second edgefold.

6. The deformable spray bottle holder, according to claim 1, wherein said second supporting is comprised of a first location hole, wherein said first supporting upper end is comprised of a second location hole, and wherein said first location hole aligns with the second location hole in said turned upside down position of said second supporting seat.

7. The deformable spray bottle holder, according to claim 1, further comprising: a hanging member being attached to said second supporting outer side and being comprised of a first pothook member connected to said second supporting seat and a second pothook member connected to said first pothook member, said second pothook member having a suspension loop.

8. The deformable spray bottle holder according to claim 1, further comprising:

a circular-arc shaped locating notch arranged at second supporting lower end;

a lateral plastic reinforcement member arranged at said second supporting upper end; and a projecting reinforcement member arranged at said second supporting outer side.

9. The deformable spray bottle holder, according to claim 1, wherein said first horizontal member comprised of an elongated location hole.

* * * * *